US006923262B2

(12) United States Patent
Broome et al.

(10) Patent No.: US 6,923,262 B2
(45) Date of Patent: Aug. 2, 2005

(54) ALTERNATE PATH AUGER SCREEN

(75) Inventors: John T. Broome, The Woodlands, TX (US); Michael J. Naquin, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 104 days.

(21) Appl. No.: 10/373,140

(22) Filed: Feb. 24, 2003

(65) Prior Publication Data

US 2004/0099412 A1 May 27, 2004

Related U.S. Application Data

(60) Provisional application No. 60/424,401, filed on Nov. 7, 2002.

(51) Int. Cl.[7] ..... E21B 43/04
(52) U.S. Cl. ..... 166/278; 166/51
(58) Field of Search ..... 166/278, 51; 100/145; 198/670, 671; 222/412, 413

(56) References Cited

U.S. PATENT DOCUMENTS

| | | | | |
|---|---|---|---|---|
| 2,371,391 A | | 3/1945 | Haynes | |
| 2,513,944 A | | 7/1950 | Kessler | |
| 2,755,861 A | | 7/1956 | Smet | |
| 3,421,586 A | | 1/1969 | Solum | |
| 3,482,627 A | | 12/1969 | Nebolsine | |
| 4,338,869 A | * | 7/1982 | Hoskinson | 110/346 |
| 4,363,366 A | * | 12/1982 | Hilty | 175/314 |
| 4,558,742 A | | 12/1985 | Huang et al. | |
| 4,945,991 A | | 8/1990 | Jones | |
| 5,004,049 A | | 4/1991 | Artebury | |
| 5,082,052 A | | 1/1992 | Jones et al. | |
| 5,113,935 A | | 5/1992 | Jones et al. | |
| 5,161,613 A | | 11/1992 | Jones | |
| 5,161,618 A | | 11/1992 | Jones et al. | |
| 5,234,055 A | | 8/1993 | Cornette | |
| 5,261,486 A | | 11/1993 | Cornette et al. | |
| 5,310,000 A | | 5/1994 | Artebury et al. | |
| 5,327,960 A | | 7/1994 | Cornette et al. | |
| 5,327,974 A | * | 7/1994 | Donovan et al. | 166/311 |
| 5,335,727 A | | 8/1994 | Cornette et al. | |
| 5,348,092 A | | 9/1994 | Cornette et al. | |
| 5,366,009 A | | 11/1994 | Cornette et al. | |
| 5,390,966 A | | 2/1995 | Cox et al. | |
| 5,394,938 A | * | 3/1995 | Cornette et al. | 166/51 |
| 5,411,090 A | | 5/1995 | Cornette et al. | |
| 5,417,284 A | | 5/1995 | Jones | |
| 5,419,394 A | | 5/1995 | Jones | |
| 5,435,391 A | | 7/1995 | Jones | |
| 5,515,915 A | | 5/1996 | Jones | |
| 5,560,427 A | | 10/1996 | Jones | |
| 5,579,843 A | * | 12/1996 | Loitherstein | 166/278 |
| 5,588,487 A | | 12/1996 | Bryant | |
| 5,622,224 A | | 4/1997 | Yates | |
| 5,842,516 A | | 12/1998 | Jones | |
| 5,848,645 A | | 12/1998 | Jones | |
| 5,868,200 A | | 2/1999 | Bryant et al. | |

(Continued)

OTHER PUBLICATIONS

Halliburton information brochure, "SurePac Multiple Path Screen System," 1 page, 2002.

*Primary Examiner*—William Neuder
(74) *Attorney, Agent, or Firm*—Steve Rosenblatt

(57) ABSTRACT

A gravel pack screen assembly has one or more hollow flight augers that a continuous or segmented with multiple upwardly oriented gravel entrances and multiple downwardly oriented gravel exits. The gravel passes through the auger and around any bridge. The auger helps advance the screen into position as well as to centralize it during gravel deposition. The auger protects the screen during run in as well as the internal passages that pass through it due to its structural rigidity. An alternative embodiment features spirally wound tubes with staggered exit locations for better distribution of the gravel.

26 Claims, 2 Drawing Sheets

U.S. PATENT DOCUMENTS

| | | | | | |
|---|---|---|---|---|---|
| 5,890,533 | A | | 4/1999 | Jones | |
| 5,988,702 | A | | 11/1999 | Sas-Jaworsky | |
| 6,059,032 | A | | 5/2000 | Jones | |
| 6,220,345 | B1 | | 4/2001 | Jones et al. | |
| 6,227,303 | B1 | | 5/2001 | Jones | |
| 6,298,916 | B1 | | 10/2001 | Tibbles et al. | |
| 6,581,689 | B2 | | 6/2003 | Hailey, Jr. | |
| 6,601,646 | B2 | | 8/2003 | Striech et al. | |
| 6,681,854 | B2 | | 1/2004 | Danos | |
| 2002/0079099 | A1 | | 6/2002 | Hurst et al. | |
| 2002/0189809 | A1 | * | 12/2002 | Nguyen et al. | 166/278 |
| 2003/0029614 | A1 | * | 2/2003 | Michel | 166/278 |
| 2003/0089495 | A1 | | 5/2003 | Bixenman | |
| 2003/0159825 | A1 | * | 8/2003 | Hurst et al. | 166/278 |
| 2003/0183386 | A1 | | 10/2003 | McGregor et al. | |
| 2003/0221829 | A1 | | 12/2003 | Patel et al. | |

* cited by examiner

ALTERNATE PATH AUGER SCREEN

PRIORITY INFORMATION

This application claims the benefit of U.S. Provisional Application No. 60/424,401, filed on Nov. 7, 2002.

FIELD OF THE INVENTION

The field of this invention relates to alternate paths for gravel during downhole gravel packing operations and more particularly to spirally shaped paths in the form of a surrounding hollow auger for a gravel pack screen assembly. Spirally wrapped shunt tubes are further contemplated.

BACKGROUND OF THE INVENTION

A common problem when gravel packing is that the gravel forms bridges and leaves gaping areas uncovered as the gravel that is subsequently delivered piles up behind the bridge or blockage. Another problem is the difficulty in delivering screen into long horizontal runs because of the limited weight available to advance the screen and the possibility that it may simply buckle in the wellbore and cease to further advance. Yet another issue is the need to centralize the screen as the gravel is delivered for deposition all around it. Another concern is damage to the screen assembly during run in. Gravel screens have been provided in the past with surrounding shrouds but the delivery to the desired location could still cause damage to the shroud and the underlying screen. Bridge formation is always a concern. Annular bridge formation can be aggravated by zones of low flow rates leading to deposition of undue amounts of gravel in concentrations in undesirable locations leading to a bridge ultimately forming.

In the past, a solid auger on a gravel pack screen has been used to insert the screen into the wellbore after the gravel has been earlier deposited. The auger helps to advance the screen into the borehole location that is already pre-charged with gravel. This method is illustrated in U.S. Pat. No. 5,036,920. Augers have been used on perforating guns to get them out after they are fired, as illustrated in U.S. Pat. Re. 34,451.

Alternate paths for the gravel comprising longitudinally oriented narrow passages disposed parallel to each other have been used to try to deliver gravel beyond a sand bridge. Some examples are U.S. Pat. Nos.: 6,298,916; 5,161,618; 6,059,032; 5,842,516; 4,945,991; 5,161,613; 5,113,935; 5,419,394; 5,417,284; 5,435,391; 5,560,427; 5,848,645; 5,622,224; 5,588,487; 5,890,533; 6,227,303; 6,220,345; 5,476,143; 5,341.880; 5,515,915; 5,082,052; 6,409,219; 5,390,966; and 5,868,200. Also of interest is the Halliburton multiple path screen system called SurePac. Some of these references have shunt tubes that are internal and others feature external tubes. These designs address the specific problem of bridging but ignore some of the other issues such as protection of the screen, advancement of the screen into position and the potential damage to the shunt tubes when mounted externally.

The present invention addresses in a cohesive design several parameters. The hollow flight or flights of augers are structurally rigid to allow rotation to advance the screen. The passages in the flights are also protected by the rigidity of the auger design. The screen is better protected during run in. The auger allows gravel to enter and exit in multiple locations to allow gravel to bypass bridges. The spiral flow pattern in the interior and along the exterior of the auger is more turbulent due to the centrifugal force from going around the screen, making it less likely that gravel will deposit within the auger or prematurely in the annulus. The auger centralizes prior to gravel delivery.

The other advantages are offered by an alternative embodiment that features spirally wound shunt tubes. These tubes are open at discrete locations for escape of gravel. The spiral layout improves gravel distribution upon exit from the tubes.

These and other advantages of the present invention will be more apparent to those skilled in the art from a review of the description of the preferred embodiment and the claims, which appear below.

SUMMARY OF THE INVENTION

A gravel pack screen assembly has one or more hollow flight augers that a continuous or segmented with multiple upwardly oriented gravel entrances and multiple downwardly oriented gravel exits. The gravel passes through the auger and around any bridge. The auger helps advance the screen into position as well as to centralize it during gravel deposition. The auger protects the screen during run in as well as the internal passages that pass through it due to its structural rigidity. An alternative embodiment features spirally wound tubes with staggered exit locations for better distribution of the gravel.

DETAILED DESCRIPTION OF THE PREFERRED EMBODIMENT

Figure 1:
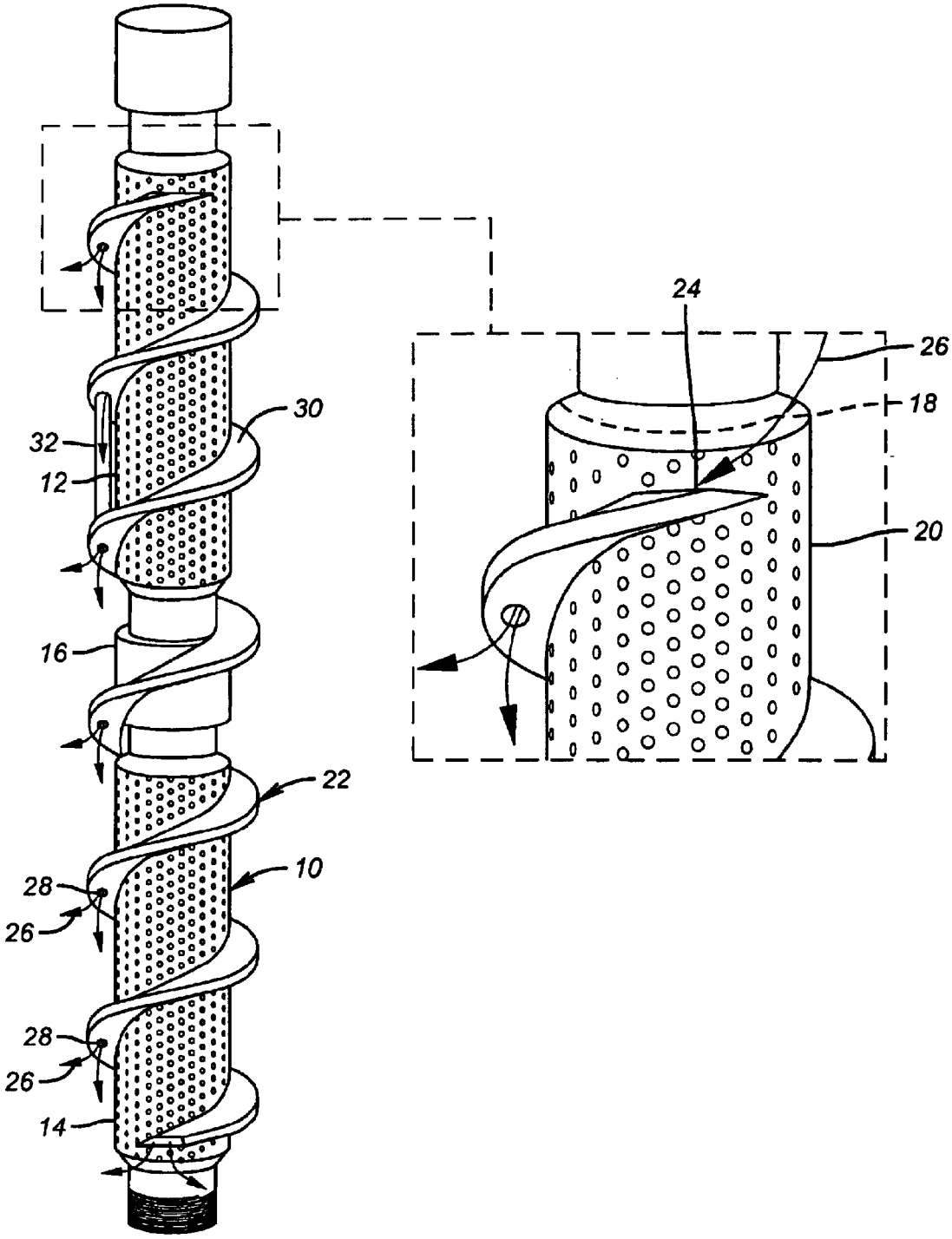
FIG. 1 is an exterior view of a screen assembly with a single flight hollow auger mounted to it showing the flow of gravel through the hollow flight.
Figure 4:
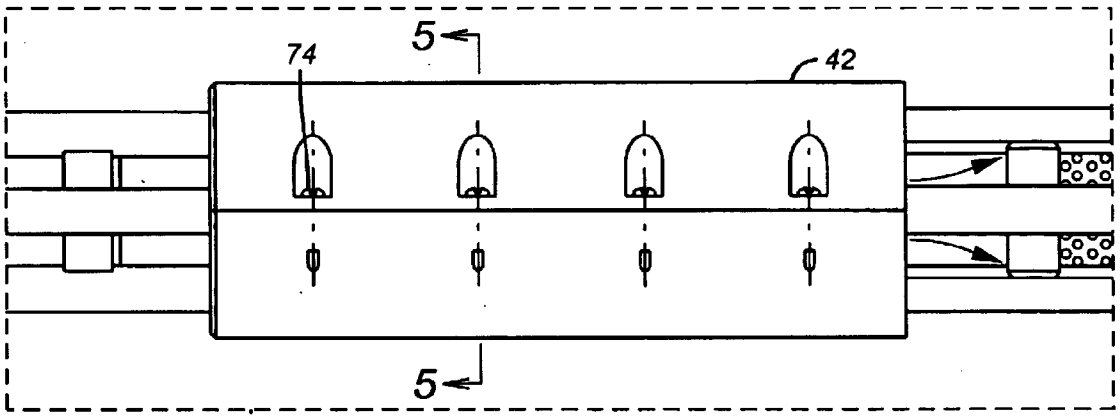
FIG. 4 shows an outer view of the jacket mounted over joints in the screen assembly.

Referring to FIG. 1 the screen assembly 10 can be made up of multiple sections such as 12 and 14 that are connected by a coupling 16. The actual screen, shown by dashed line 18 is below an outer protective jacket 20. The protective jacket 20 stops short of each coupling 16 so that the proper length of the assembly 10 can be put together for a given application. The auger 22 is hollow and has an inlet 24 near the top where gravel, represented by arrow 26 can enter. There is a plurality of exits 28 on the auger underside for the gravel 26 to exit. The auger 22 may be made continuous over the couplings 16 such as by installing the segments that pass the coupling 16 after it is assembled. Alternatively, the auger 22 can stop before some or all of the couplings 16 and resume on the protective jacket 20 immediately below the coupling 16. In this manner there can be multiple inlets 24 where each section of auger 22 begins. Additionally or alternatively, there can be additional inlets on the uphole side 30 of auger 22 for the purpose of letting in gravel 26 at multiple points along a length of continuous auger 22.

The pitch and/or diameter of auger 22 can be constant or variable. There can be a single auger 22 or nested augers. Auger 22 may be made of the same metallic material as the protective jacket 20 and attached by a variety of techniques, although welding is preferred. Alternatively the auger 22 can be non-metallic as can be the protective jacket 20. They can be made integrally or the auger 22 can be mounted separately to jacket 20. The inlets 24 and outlets 28 can have a variety of shapes and sizes guided by the need to maintain the structural integrity of the auger 22 during conditions of its rotation to advance the screen assembly 10 into position before the gravel 26 is deposited in a known manner. All or less than all of the length of the screen assembly 10 can be covered with the hollow auger 22. Periodically, short cut passages 32 can extend longitudinally from the underside of auger 22 to the uphole side 30 immediately below as yet another path for the gravel 26 to take if auger 22 starts to plug internally.

Those skilled in the art will appreciate that the presence of auger 22 creates turbulence around the screen assembly 10 so as to make it less likely in the first place that sand bridges will form. The presence of the hollow auger 22 allows the gravel alternate paths to enter at the start or along the way on each auger or segment thereof and to exit on the downhole side of the auger or its segments anywhere along the length where an outlet is provided and at all lower open ends of hollow auger 22. The auger 22 acts as a centralizer on the trip downhole. It also protects the screen assembly 10 from mechanical damage during run in. The auger 22 also helps to advance the screen assembly into proper position. This can be useful in a nearly horizontal run where the ability to push the screen assembly 10 forward without buckling it may be severely limited. This problem can occur in regions of shale instability where contact by water based fluids makes the shale unconsolidated so that it can collapse into the wellbore. If this happens the alternate paths through the auger 22 allow gravel to also bypass the region of shale collapse. The auger 22 can be assembled to the protective jacket 20 such as by welding and then the assembly can be rolled over the screen material and secured to the base pipe underlying the screen material. Removal of the screen assembly 10, should that become necessary, is made easier by just applying an uphole force to the screen assembly 10. The auger 22 will put the screen assembly into rotation and the pitch of the auger 22 will drive the auger out of the gravel.

Accordingly, the auger 22 in its various embodiments described above addresses several potential problems involved in running gravel pack screens. The alternate paths create internal turbulence and centrifugal force that helps to minimize blockages internally in the flow paths. Externally, turbulence is also created by auger 22 to help fight sand bridging.

Figure 5:
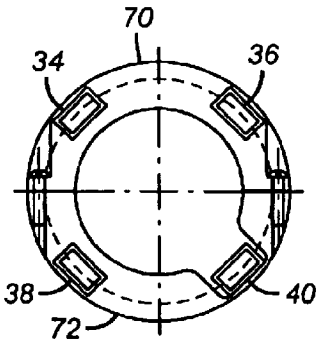
FIG. 5 is the view along lines 5—5 of FIG. 4.
Figure 2:
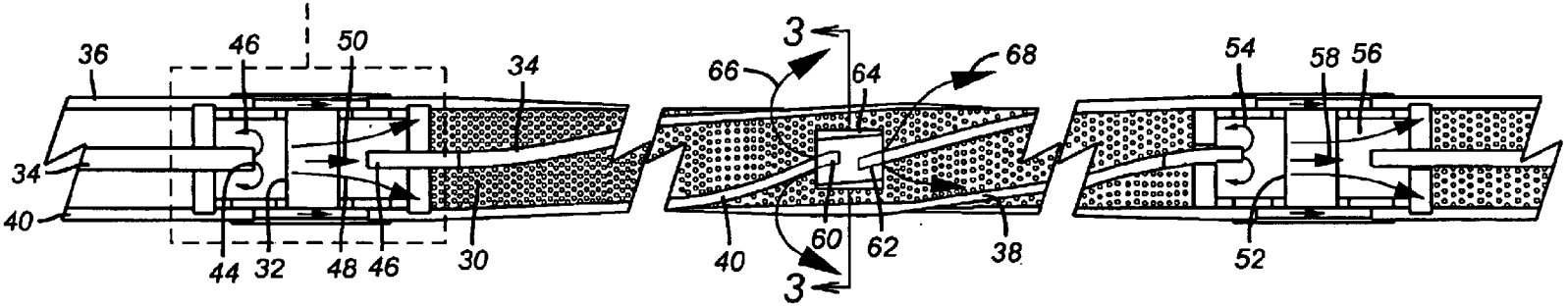
FIG. 2 is a section view of an alternative embodiment showing the spirally wrapped tubes.
Figure 3:
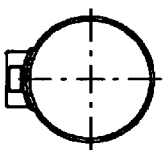
FIG. 3 is the view along lines 3—3 of FIG. 2.

FIG. 2 illustrates an alternative embodiment of the present invention. The screen 30 is assembled in sections and connected by joints 32. Illustratively, four shunt tubes 34, 36, 38, and 40 as best seen in the section view of FIG. 5 are disposed on the outside of screen 30. In the preferred embodiment, the shunt tubes 34, 36, 38, and 40 are equally spaced and spirally wound on the same pitch over the length of the screen assembly. Mounted over each joint 32 is a jacket 42. As shown in FIG. 2, at least one of the shunt tubes 34, 36, 38, and 40 has an exit 44 under jacket 42. It also has an entrance 46 under jacket 42. Flow coming downhole through tube 34 exits and goes in three directions represented by arrows 46, 48, and 50. Arrow 46 shows the gravel exiting above the jacket 42, arrow 48 shows the gravel exiting below the jacket 42 and arrow 50 shows the gravel re-entering tube 34 under jacket 42. Jacket 42 provides a jumper path for each other tube such as tubes 36 and 40 shown in FIG. 2. Jacket 42 can have a discrete path for an individual tube or it can provide a common manifold so that flow from a variety of tubes can mix within the jacket and exit a different tube from the tube that a particular flow entered the jacket 42. At the next joint 52, a different tube 38 is open for flow in three possible directions as indicated by arrows 54, 56, and 58. In between joints 32 and 52 at least one tube such as 40 has open ends 60 and 62 to allow flow out from under open coupling 64. Flow can go out above coupling 64 as indicated by arrows 66 and out below, as indicated by arrows 68. Between joints such as 32 and 52 a single tube may have one or more couplings 64. Alternatively more than one tube can have one or more couplings 64 between typical joints such as 32 and 52. As another variation, more than one of tubes 34, 36, 38, and 40 can have open ends under the jacket 42. The jacket 42 can be made in pieces 70 and 72 and held together by one or more bolts 74.

Those skilled in the art will appreciate that the spiral winding will increase the overall length of the shunt tubes 34, 36, 38, and 40 as the wrap around the screen 30 but the fluid velocity will be higher as the spiral flow path will aid distribution of the gravel as it emerges from any openings in the shunt tubes 34, 36, 38, and 40. The spiral pattern will also better protect the screen 30 on insertion and help to better center it when it reaches the desired location. Those skilled in the art will also appreciate that the number of tubes can be varied as well as their initial spacing and pitch. The diameter of an individual tube can be varied along its length. In the preferred embodiment if there are four tubes equally spaced and spirally wound on the same pitch, each tube will have breaks over a fourth of the length of the screens 30 with no or minimal zone overlap. Alternatively, jacket 42 can be eliminated in favor of a jumper tube at a joint such as 32 for those tubes that have no openings at that location while the tubes with openings can have a coupling such as 64 at a joint such as 32.

The above description is illustrative of the preferred embodiment and many modifications may be made by those skilled in the art without departing from the invention whose scope is to be determined from the literal and equivalent scope of the claims below:

We claim:

1. A gravel packing apparatus, comprising:

a screen;

at least one auger, having a passage therein, said auger mounted to the screen and having at least one inlet opening outside said screen and at least one outlet opening outside said screen to allow an alternate path for gravel deposition outside said screen.

2. The apparatus of claim 1, wherein:

said auger has an uphole oriented face and a downhole oriented face and at least one said opening in said downhole oriented face.

3. The apparatus of claim 2, wherein:

said auger has at least one said opening in said uphole oriented face.

4. The apparatus of claim 1, wherein:

said auger has an upper and a lower end with at least one of said ends being open to said passage.

5. The apparatus of claim 1, wherein:

said screen is covered by a jacket and said auger is mounted over said jacket.

6. The apparatus of claim 5, wherein:

said auger extends over connecting joints for said screen.

7. The apparatus of claim 5, wherein:

said auger is discontinuous at connecting joints for said screen.

8. The apparatus of claim 1, wherein:

said auger imparts a rotational force to said screen when said screen is subjected to an axial force to assist in advancing said screen in one of an uphole and a downhole direction.

9. The apparatus of claim 1, wherein:

said at least one auger comprises a plurality of augers.

10. The apparatus of claim 1, wherein:

said auger comprises a variable pitch along its length.

11. The apparatus of claim 1, wherein:

said auger comprises a variable diameter along its length.

12. The apparatus of claim 1, wherein:

said passage imparts a centrifugal force to flow going through said passage to aid in expelling said flow from said outlet.

13. A gravel packing apparatus, comprising:

a screen at least one auger, having a passage therein, said auger mounted to the screen having at least one inlet opening and at least one outlet opening;

said auger has an uphole oriented face and a downhole oriented face and at least one said opening in said downhole oriented face;

said auger comprises at least one opening on said uphole oriented face and an exterior passage connecting said opening on the downhole oriented face with said opening on said uphole oriented face.

14. A gravel packing apparatus, comprising:

a screen;

at least one non-manifolded tube spirally wrapped about said screen and having at least one inlet and at least one outlet, said tube being one of continuous extension to define said spiral wrapping and comprising segments wherein adjacent segments that define said spiral wrapping have substantially aligned ends.

15. The apparatus of claim 14, wherein:

said screen comprises a plurality of joints and said inlet and outlet of said tube further comprises a gap located by at least one said joint.

16. The apparatus of claim 14, wherein:

said tube has at least one gap located between two said joints.

17. The apparatus of claim 14, wherein:

the pitch of said tube is one of constant and variable.

18. The apparatus of claim 14, wherein:

said at least one tube comprises a plurality of tubes.

19. The apparatus of claim 18, wherein:

said tubes are substantially parallel to each other.

20. The apparatus of claim 18, wherein:

said tubes are disposed in a plurality of spiral pitches.

21. A gravel packing apparatus, comprising:

a screen;

at least one tube spirally wrapped about said screen and having at least one inlet and at least one outlet;

said screen comprises a plurality of joints and said inlet and outlet of said tube further comprises at least one gap;

at least one said gap is covered by a coupling which permits leakage flow out of and into said tube.

22. A gravel packing apparatus, comprising:

a screen;

at least one tube spirally wrapped about said screen and having at least one inlet and at least one outlet;

said screen comprises a plurality of joints and said inlet and outlet of said tube further comprises at least one gap located by at least one said joint;

at least one said gap is covered by a coupling which permits no leakage flow out of and into said tube.

23. A gravel packing apparatus, comprising:

a screen;

at least one tube spirally wrapped about said screen and having at least one inlet and at least one outlet;

said at least one tube comprises a plurality of tubes;

said screen comprises a plurality of joints and each said tube has a gap located by at least one said joint;

said gaps are covered by at least one coupling that permits flow to enter and exit from said gap for at least one tube and is sealed for at least one other tube.

24. The apparatus of claim 23, wherein:

said coupling seals a plurality of tubes by providing a discrete passage for each tube.

25. The apparatus of claim 23 wherein:

said coupling seals a plurality of tubes by providing a manifold.

26. A gravel packing apparatus, comprising:

a screen;

at least one tube spirally wrapped about said screen and having at least one inlet and at least one outlet;

said screen comprises a plurality of joints and said inlet and outlet of said tube further comprises a gap located by at least one said joint;

said inlet, outlet and gap on one of said tubes are disposed in a discrete segment of said screen from said inlet, outlet and gaps in said other tubes.

* * * * *